US005797268A

United States Patent [19]

Ryan

[11] Patent Number: 5,797,268

[45] Date of Patent: Aug. 25, 1998

[54] PARTIALLY SWIRLED MULTI-SWIRL COMBUSTOR PLATE AND CHIMNEYS

[75] Inventor: William Richard Ryan, Orlando, Fla.

[73] Assignee: Westinghouse Electric Corporation, Pittsburgh, Pa.

[21] Appl. No.: 675,981

[22] Filed: Jul. 5, 1996

[51] Int. Cl.[6] ..... F02G 3/00

[52] U.S. Cl. ..... 60/748; 60/747; 60/39.091

[58] Field of Search ..... 60/39.091, 737, 60/747, 748

[56] References Cited

U.S. PATENT DOCUMENTS

| | | | |
|---|---|---|---|
| 4,107,918 | 8/1978 | Andrew et al. | 60/39 |
| 4,356,698 | 11/1982 | Chamberlain | 60/733 |
| 4,408,461 | 10/1983 | Bruhwiler et al. | 60/737 |
| 4,539,918 | 9/1985 | Beer et al. | 110/266 |
| 4,845,940 | 7/1989 | Beer | 60/732 |
| 4,967,561 | 11/1990 | Bruhwiler et al. | 60/748 |
| 5,359,847 | 11/1994 | Pillsbury et al. | 60/39.06 |
| 5,361,586 | 11/1994 | McWhirter et al. | 60/737 |
| 5,437,158 | 8/1995 | Fric | 60/739 |
| 5,505,045 | 4/1996 | Lee et al. | 60/748 |

*Primary Examiner*—Charles G. Freay

[57] ABSTRACT

A multi-swirl combustor plate is disclosed. The multi-swirl combustor plate contains a plurality of swirlers arranged around an interior section of the combustor plate, and a plurality of non-swirled holes arranged around an exterior section of the plate that had been cast as a solid section. The swirlers are preferably arranged in concentric circles, and the non-swirled holes are also preferably created in concentric circles disposed outside of the swirlers. In accordance with the present invention, each of the swirlers also preferably comprises an outer wall having a thickness greater than that of the multi-swirl plate and is an extension of the multi-swirl plate disposed in the downstream direction. Similarly, the swirler hub also has a thickness greater than that of the plate is an extension disposed in the downstream direction. Methods of making a swirler plate are also disclosed that include the step of first casting a plate comprising a center section having a number of swirlers and a solid outer section. The solid outer section is then subsequently machined to create a plurality of non-swirled holes. Preferably, two concentric rings of swirlers are cast and/or concentric rings of non-swirled holes are created. The present invention thus permits the patterns of swirlers and non-swirled holes to be varied depending upon the demands of a particular turbine.

14 Claims, 3 Drawing Sheets

PARTIALLY SWIRLED MULTI-SWIRL COMBUSTOR PLATE AND CHIMNEYS

FIELD OF THE INVENTION

The present invention relates to combustion turbines, and, more particularly, to combustors having fuel-air premixing passages.

BACKGROUND OF THE INVENTION

Premixed combustors were developed to comply with the Clean Air Act ("CAA") of 1970, as amended in 1977 and 1990. In particular, the CAA environmental regulations place limits on the levels of $NO_x$ (oxides of nitrogen) emissions from stationary gas turbine systems. The limits set by the CAA regulations are relatively low, for example, requiring less than 9 ppm (parts per million) $NO_x$ dry corrected to 15% $O_2$ (dioxide). Uncontrolled values are on the order of 300 ppm. One technique to meet the required $NO_x$ emission levels is the use of a lean fuel mixture that is premixed prior to combustion. Such a fuel mixture reduces the flame temperature during combustion and thereby reduces emission levels.

However, a flame can sometimes propagate ("flash back") from the combustion zone into the fuel-air premixing passages, creating a possibility that the components of the combustor will be damaged. Thus, it would be desirable to provide a premixed combustor that prevents flame flashback from the combustion zone to the premixing passages.

The use of multi-swirl combustor plates in turbine combustors to reduce $NO_x$ emissions is known in the art. For example, U.S. Pat. No. 5,361,586—McWhirter et al., which is assigned to the assignee of the present invention and is hereby incorporated by reference as if set forth in its entirety herein, discloses a combustor that generates a low level of $NO_x$ emissions. In the disclosed combustor, a premixing zone and a combustion zone are separated by a barrier plate. In the pre-mixing zone, a lean fuel/air mixture is introduced through a plurality of concentrically arranged annular passages. At the end of each annular passage, swirlers are arranged that permit entry into the combustion zone and also act as flame holders.

In typical multi-swirl combustors made in accordance with the concepts disclosed in the above-described patent, the combustor plate contains ninety-two (92) individual swirlers arranged in four concentric circles. The drawback of this design is that there are very long lead times and very high expenses for the tooling necessary to manufacture this plate. These delays and costs are exacerbated by the requirement that each plate is more or less custom designed for a particular application, and at best, one design is useful only in very similar turbines.

SUMMARY OF THE INVENTION

It has been found that a combustor containing a plurality of swirlers arranged in multiple concentric circular rings mounted in a single plate, through which a fuel-air mixture is passed, is capable of producing low levels of $NO_x$ while maintaining excellent combustion characteristics. These swirler plates are difficult to manufacture and must be tailored to each application (i.e. each size gas turbine). The present invention is directed to methods of making a swirler plate by first casting a plate comprising a center section having a number of swirlers as in the previous art and a solid outer section. The solid outer section is then subsequently machined to create a plurality of non-swirled holes in the outer section. The attendant advantages of the present invention, described more fully below, include the ability to vary the pattern and size of non-swirled holes depending on the demands of a particular turbine. Thus, a single type of plate can be used for a wide variety of applications. In preferred embodiments of the methods of the present invention, two concentric rings of swirlers are cast and/or concentric rings of non-swirled holes are machined into the plate.

In accordance with another aspect of the present invention, the outer shroud and centerbody of each swirler is extended in the direction of flow, creating a "chimney" downstream of the swirler exit. The chimney increases the flashback resistance of the swirler plate and improves flame stability. Thus, in addition to the overall swirler plate design, the present invention also provides improvements in swirler design by disclosing swirlers wherein the outer shroud and centerbody are extended in the direction of flow forming a chimney downstream of the swirler exit.

DETAILED DESCRIPTION OF THE PREFERRED EMBODIMENTS

Figure 1:
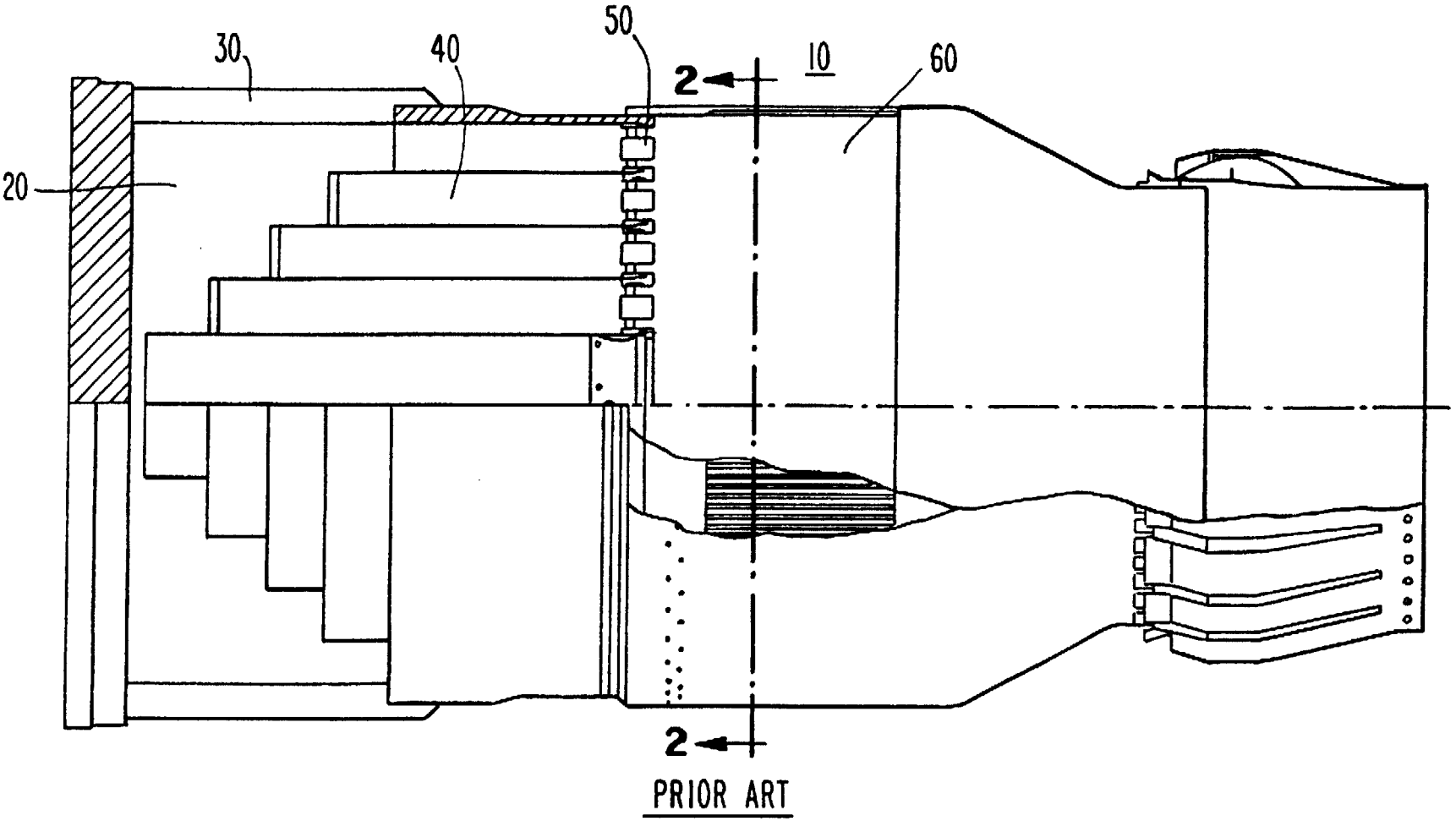
PRIOR ART Fig. 1
FIG. 1 is a side elevation view, partially cut away, of a multi-swirl combustor.

A multi-swirl combustor 10 is illustrated in FIG. 1, and includes a fuel injector 20, a port for atmospheric air 30, fuel-air premixing passages 40, swirlers 50, and a combustion zone 60 where the swirled fuel-air mixture is combusted.

Figure 2:
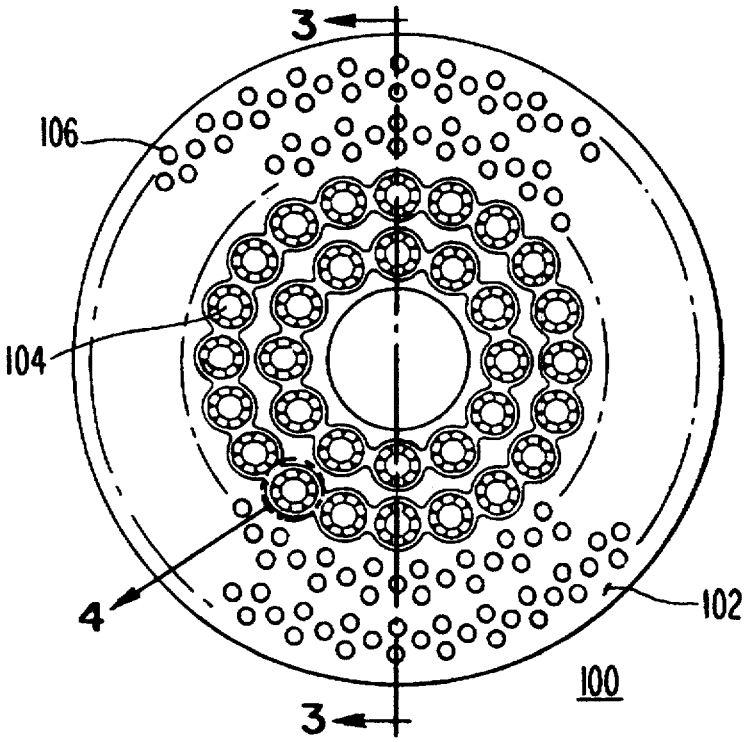
FIG. 2 is a cross-sectional view, taken along lines 2—2 of FIG. 1 that illustrates a multi-swirl plate made in accordance with the present invention.

The present invention is directed to a multi-swirl plate 100 that is illustrated in FIG. 2, which shows a cross-sectional view of a multi-swirl plate combustor taken at line 2—2 in FIG. 1. The multi-swirl plate 100 of the present invention is comprised of a plate 102 that contains a number of individual swirlers 104. In accordance with the present invention, the multi-swirl plate 100 has two inner concentric rings of swirlers 104, for example a first circle containing twelve (12) individual swirlers and a second circle containing twenty (20) swirlers, and the outer section is initially made as a solid cast section. In other words, two outer rings of swirlers provided in prior designs are not retained. Instead, the solid cast outer section is subsequently machined with non-swirled holes 106. As will be understood by those of skill in the art, the diameter of the non-swirled holes 106 can be readily chosen based upon the application.

Machining the solid outer section allows one set of tooling to create swirler plates 100 that can be used across a broad turbine product line. The inner two rings of swirlers 104 provide stability throughout the load range typically encountered. On the other hand, the non-swirled holes 106 located where the outer rings of swirlers were previously located provide decreased dynamics at the base load condition when all stages are fired.

Figure 3:
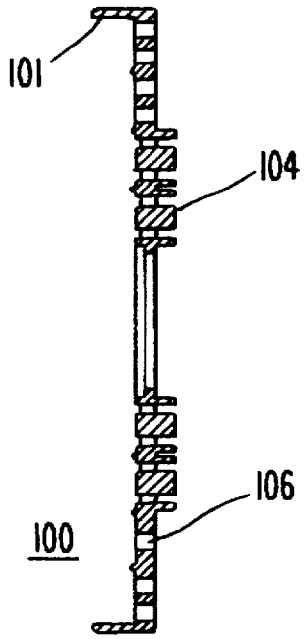
FIG. 3 is a cross-sectional view, taken along lines 3—3 of FIG. 2 that illustrates the cross-sections of the orifices of a swirl plate made in accordance with the present invention.

FIG. 3 illustrates a cross-section of the combustor plate 100 illustrated in FIG. 2, taken along line 3—3. As explained in further detail below, in certain preferred embodiments, the swirlers 104 will extend beyond the thickness of the plate 100 in the downstream direction. Also seen in FIG. 3 is the rim 101 of the swirler plate 100 that extends beyond the upstream side of the plate 100.

Figure 4:
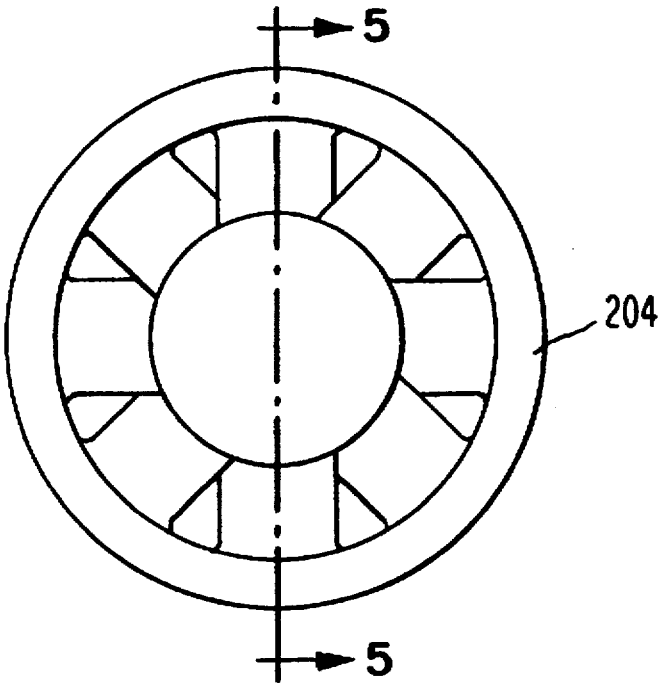
FIG. 4 is an elevation view, broken away from FIG. 2, illustrating an improved swirler made in accordance with another aspect of the present invention.

Another aspect of the present invention relates to the design of the swirlers 104, and can be described as a "chimney" concept. This aspect of the present invention was explained with reference to FIG. 3, and is more fully illustrated in FIGS. 4–5, which show a preferred embodiment of an individual swirler 204, corresponding in use to the swirler 104 shown in FIGS. 2–3. It should be understood, however, that the present invention contemplates using the swirler illustrated in FIGS. 4–5 in many different applications. Conversely, the swirler plate 100 described above with reference to FIGS. 2–3 may be employed with any swirler design and does not require swirlers made in accordance with the present invention, or as illustrated in FIGS. 4–5.

Figure 5:
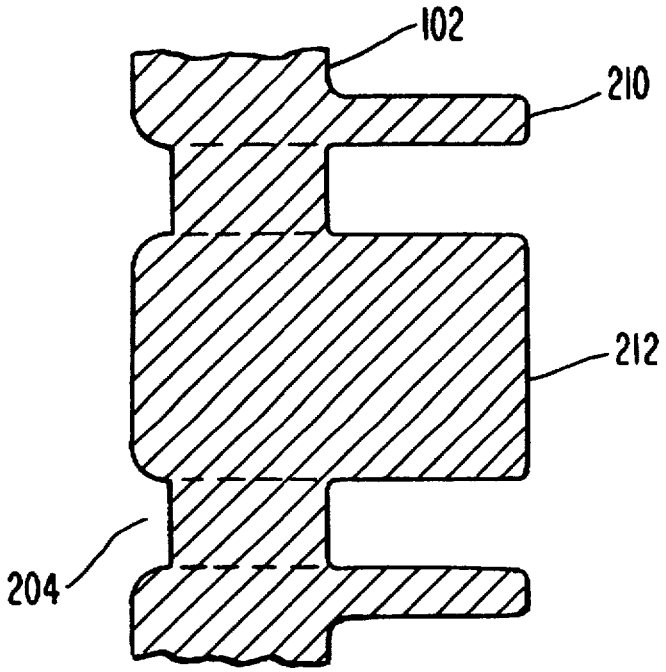
FIG. 5 is a cross-sectional view, taken along lines 5—5 of FIG. 4 that illustrates the cross-section of the central hub section of the swirler illustrated in FIG. 4.

As seen in the broken away cross-sectional view of FIG. 5, an outer wall 210 extends from the surface of the multi-swirl plate 102, preferably in the downstream direction. An extension of the swirler hub 212 also preferably extends in the downstream direction. It has been found that flashback resistance is enhanced by increasing the axial length of the high velocity region through which a flame must actually travel before flashing back. Additionally, flashback resistance is increased by enhancing the quenching effect that the swirler 204 has on the flame as it tries to travel throughout the high velocity region. High pressure tests indicate that while the possibility of flashback is not precluded entirely, resistance to flashback is significantly increased when the designs disclosed herein are employed.

The quenching of the flame is related to decreased metal temperatures in the vicinity of the actual swirler. In particular, the vanes should operate at temperatures that are very close to the inlet air temperature since they are not in intimate contact with the combustion zone. As a result, the durability of the vanes will be improved if a flashback does in fact occur. The improved durability has been verified by testing the present invention in transient tests run at high pressure. In addition, air flow tests have shown that the "chimneys" made in accordance with this aspect of the present invention act as diffusers between the swirler exit and the combustion zone. The present invention therefore also supplies the additional benefit of increasing the effective area of the swirlers 104, and as a result, permits more flow through the same geometric area. Thus, bulk velocity through the swirler 104 is increased, consequently adding to the flashback resistance of the swirler plate.

Although the invention has been described in terms of an exemplary embodiment, the spirit and scope of the appended claims are not to be limited by any details not expressly stated in the claims. Upon review of the foregoing, numerous alternative embodiments will present themselves to those of skill in the art. Accordingly, reference should be made to the appended claims in order to determine the full scope of the present invention.

I claim:

1. A gas turbine combustor comprising a multi-swirl combustor plate containing a plurality of swirlers arranged around an interior section of the multi-swirl combustor plate, and a plurality of non-swirled holes machined in a solid exterior section of the multi-swirl combustor plate.

2. The combustor of claim 1, wherein the plurality of swirlers is arranged in one or more concentric circles.

3. The combustor of claim 2, wherein a first concentric circle of swirlers contains twelve (12) individual swirlers.

4. The combustor of claim 3, wherein a second concentric circle of swirlers contains twenty (20) individual swirlers.

5. The combustor of claim 1, wherein the plurality of non-swirled holes is arranged in two concentric circles disposed outside of the swirlers.

6. The combustor of claim 1, wherein at least one of said plurality of swirlers comprises an outer wall having a thickness greater than that of the multi-swirl combustor plate.

7. The combustor of claim 6, wherein the outer wall forms an extension of the multi-swirl combustor plate and is disposed in a downstream direction.

8. The combustor of claim 1, wherein at least one of said plurality of swirlers comprises a swirler hub having a thickness greater than that of the multi-swirl combustor plate.

9. The combustor of claim 8, wherein the swirler hub forms an extension of the multi-swirl combustor plate and is disposed in a downstream direction.

10. A swirler mounted in a multi-swirl combustor plate, said swirler comprising an outer wall having a thickness greater than that of said multi-swirl combustor plate, further comprising a swirler hub having a thickness greater than that of the multi-swirl combustor plate.

11. The swirler of claim 10, wherein the swirler hub forms an extension of the multi-swirl combustor plate and is disposed in a downstream direction.

12. A swirler mounted in a multi-swirl combustor plate, said swirler comprising a swirler hub having a thickness greater than that of the multi-swirl combustor plate.

13. The swirler of claim 12, further comprising an outer wall having an extension which is disposed in a downstream direction.

14. The swirler of claim 13, wherein said extension forms an extension of said multi-swirl combustor plate.

* * * * *